US005165573A

United States Patent [19]

Kuboshima

[11] Patent Number: 5,165,573

[45] Date of Patent: Nov. 24, 1992

[54] ADHESIVE CONTAINER

[75] Inventor: Yasuyuki Kuboshima, Tokyo, Japan

[73] Assignee: Florex Co., Ltd., Tokyo, Japan

[21] Appl. No.: 673,764

[22] Filed: Mar. 20, 1991

[30] Foreign Application Priority Data

Oct. 12, 1990 [JP] Japan ..... 2-272214

[51] Int. Cl.[5] ..... B65D 37/00

[52] U.S. Cl. ..... 222/92; 222/206; 222/420; 222/562; 220/306; 220/352

[58] Field of Search ..... 222/92, 106, 147, 206, 222/420, 491, 562; 215/205, 224, 270, 271, 317, 320, 321; 220/240, 306, 352, 356, 361, 363

[56] References Cited

U.S. PATENT DOCUMENTS

| | | | |
|---|---|---|---|
| 2,050,246 | 8/1936 | Colvin | 222/206 |
| 2,266,270 | 12/1941 | Roth | 220/352 X |
| 2,778,525 | 1/1957 | Lermer | 220/306 |
| 4,958,748 | 9/1990 | Otake | 222/420 X |

FOREIGN PATENT DOCUMENTS

| | | | |
|---|---|---|---|
| 0191793 | 9/1957 | Austria | 222/562 |
| 0882655 | 12/1953 | Fed. Rep. of Germany | 222/562 |
| 0058609 | 3/1954 | France | 222/420 |
| 0321318 | 6/1957 | Switzerland | 222/420 |

*Primary Examiner*—D. Glenn Dayoan
*Attorney, Agent, or Firm*—Koda and Androlia

[57] ABSTRACT

An adhesive container including an adhesive reservoir, a discharge opening provided at one end of the reservoir, an adhesive inlet provided at the other end of the reservoir, and a bottom cap having two projections inside. When the cap is attached to the inlet of the container, one of the projections slips over an annular step formed on the inlet of the container to secure the cap to the container, and when the cap is bent due to the increased inside pressure of the container, the other projection inside the cap comes into contact with the adhesive inlet, preventing the cap from coming off the container.

2 Claims, 2 Drawing Sheets

ADHESIVE CONTAINER

BACKGROUND OF THE INVENTION

1. Field of the Invention

The present invention relates to a container for an instant adhesive agent and more particularly to an adhesive container equipped with a bottom cap.

2. Prior Art

Since instant adhesive agents dry quickly, containers for such adhesive agents must be air-tight when not in use. For the same reason, the containers must be designed so that only a small amount of adhesive agent is discharged during the use. Accordingly, a discharge opening of a container is small so that the adhesive agent in the container does not solidify.

FIG. 6 shows an example of a conventional adhesive container. Container 1 comprises a main body 2 and a bottom cap 8. The main body 2 is made up with a fill-in opening 5, a reservoir 3 and a discharge opening 4. The reservoir 3 is filled with a predetermined amount of adhesive agent via the fill-in opening 5, and the bottom cap 8 is screw-attached to the opening 5. When the reservoir 3 is pressed by fingers, the adhesive agent is discharged from the discharge opening 4.

FIG. 7 shows the inner structure of the cap 8. A spiral projection **8*b* is formed on the internal circumferential surface of the bottom cap 8. After the bottom cap 8 is placed on the opening 5, the spiral projection 8*b* is screw-engaged with spiral step portion 5*b* formed on the external circumferential surface of the fill-in opening 5 so that center plug 8*c* of the cap 8 closes the opening 5. The outer surface 8*a* of the cap 8 is knurled, facilitating an easy attachment of the cap 8 to the opening 5**.

As seen from the above, since the bottom cap 8 is a screw-on type, much labor is required to attach it after the container is filled with adhesive agent. This results in low productivity, and therefore, the containers do not meet mass production.

Furthermore, in order to secure an easy screw-on of the cap 8 to the opening 5, very high dimensional precision is inevitable for the spiral-form projection **8*b* and spiral-form step part 5*b***. As a result, manufacturing costs tend to high.

In addition, since the external circumferential surface **8*a* of the cap 8 is knurled, the manufacturing costs are high, and it is impossible to attach labels to the cap due to the indentations and projections of the outer surface of the cap 8**.

Still further, if a user should inadvertently loosen the bottom cap 8, the air-tightness of the container is lost, and the adhesive agent in the container will quickly solidify. Also, there is a danger that the adhesive agent will leak out of the container, contaminating the skin and clothing of the user, etc.

SUMMARY OF THE INVENTION

Accordingly, the present invention was made in light of the problems in the prior art, and the primary object of the present invention is to provide an adhesive container which renders the bottom cap to be attached to the container quickly and easily during the manufacture step.

Another object of the present invention is to provide an adhesive container which can be manufactured at low cost and which can prevent the bottom cap from coming off the container during the use, securing a sufficient air-tightness.

The present inventors conducted diligent research to solve the problems in prior art screw-on type bottom caps. As a result of the research, the inventors discovered that a high-efficient safety container is obtainable by a push-on type bottom cap. Since the bottom cap of this type tends to loosen to come off when the container is pressed (or squeezed) and internal pressure is increased when a passage to discharge opening is clogged, the inventors came up with an idea to form a special type of projection on the internal circumferential surface of the cap.

The adhesive container of the present invention includes (a) an adhesive reservoir section storing the quick-dry adhesive agent, (b) an outlet section provided at one end of the reservoir section, (c) an adhesive inlet section provided at the other end of the reservoir section, and (d) a bottom cap to be placed on the inlet section, and improvements thereof are that (1) an annular step portion is provided on the outer surface of the inlet section, (2) a first projection is formed inside the bottom cap near the open end thereof so that the first projection can engage with the annular step portion and comes into contact with the inlet section, and (3) a second projection is formed inside the bottom cap near the closed end thereof so that the second projection stays not in contact with inlet section when the cap is on.

When the cap is attached to the inlet section, the first projection slips over the annular step portion with a space left between the second projection and the outer surface of the inlet section. When the reservoir section is pressed and the internal pressure thereof is increased, the opening edge of the bottom cap is deformed. This results in that the opening of the cap is widened, the first projection comes apart from the inlet section and the second projection comes into contact with and is pressed against the outer surface of the inlet section. Thus, the bottom cap can securely stay on the outlet section, not coming off the container.

DETAILED DESCRIPTION OF THE INVENTION

One embodiment of the present invention will be described with reference to the accompanying drawings.

Figure 2:
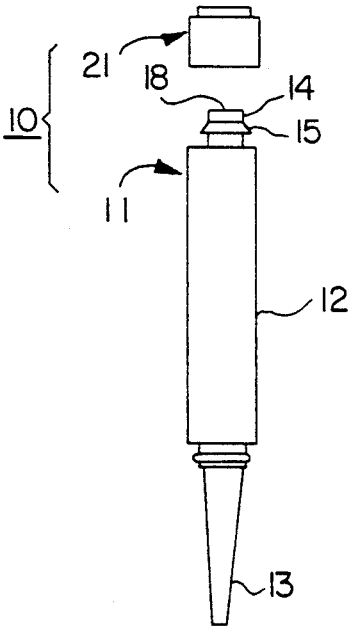
FIG. 2 is an overall schematic view of the adhesive container of the present invention.

As shown in FIG. 2, container 10 consists of a main body 11 and a bottom cap 21. The adhesive reservoir section 12 of the main body 11 is a long, slender cylinder, and a discharge opening section 13 is formed at one end of the reservoir section 12. An inlet section 14 is formed at the other end of the reservoir section 12 so that the reservoir section 12 is filled with adhesive agent via an opening 18 of the inlet section 14. The inlet section 14 is covered by the bottom cap 21.

Figure 3:
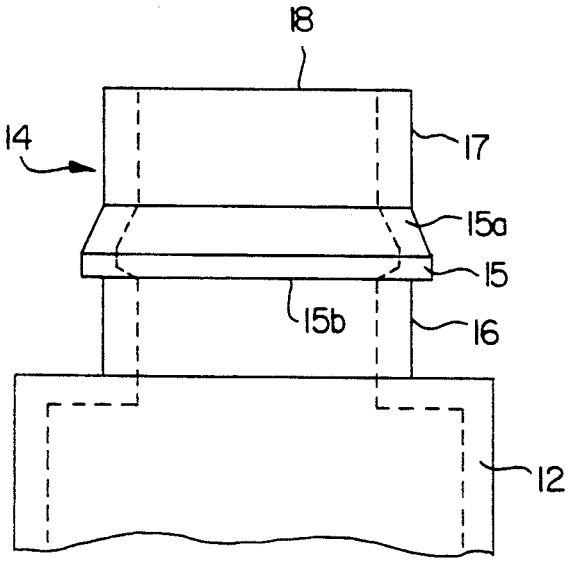
FIG. 3 shows an inlet section of the container.
Figure 7:
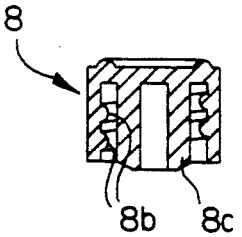
FIG. 7 PRIOR ART
FIG. 7 is a vertical cross section of a conventional bottom cap.

As seen in FIG. 3, an annular step 15 is formed at the middle portion (height-wise) of the inlet section 14. This annular step 15 has a taper guide portion 15*a* and a step-form engaging portion 15*b*. The guide portion 15*a* gradually decreases in diameter towards the opening 18, so that the bottom cap 21 can smoothly slide over the taper guide portion 15*a*.

Figure 4:
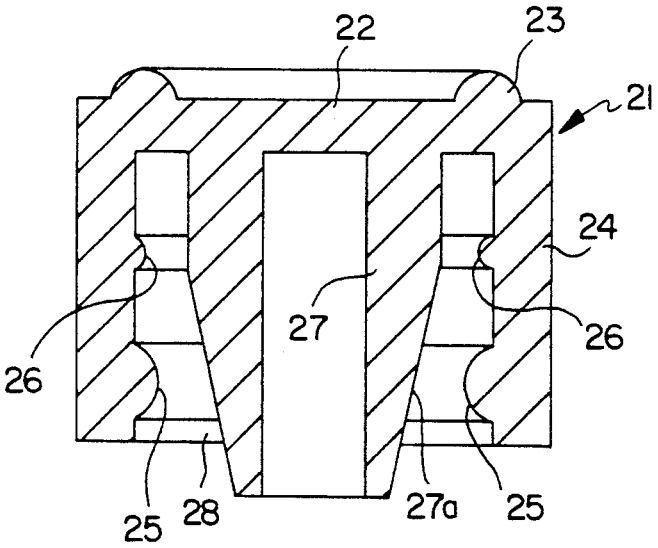
FIG. 4 is a vertical cross sectional view of the bottom cap of the container.

FIG. 4 shows the bottom cap 21. The bottom cap 21 consists of a closed end 22 and a side wall 24.

A center plug 27 is formed concentrically inside the side wall 24, and an annular projection 23 is formed on the closed end 22. Tip portion 27*a* of the center plug 27 is formed so that the external diameter gradually decreases downward (in the drawing). Thus, the center plug 27 can easily be inserted into the opening 18 of the inlet section 14 of the container 10.

Two annular projections 25 and 26 are provided so that each of them projects from the internal circumferential surface of the side wall 24 of the cap 21. The first projection 25 is formed in the vicinity of the cap opening 28. The second projection 26 is formed in the vicinity of the closed end 22 of the cap 21. The second projection 26 is smaller than the first projection 25. For example, the first projection 25 is approximately 5 mm high, and the second projection 26 is approximately 3 mm high. The first and second projections 25 and 26 are not limited to an entirely annular form; they can be a broken annular form.

Filling the container with adhesive agent and attaching the bottom cap 21 to the inlet section 14 will be described below.

Figure 5:
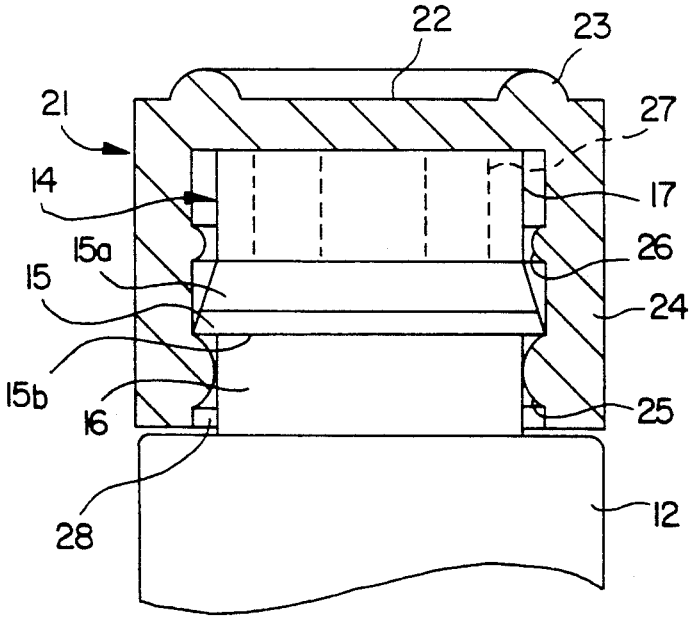
FIG. 5 is a vertical cross sectional view showing the bottom cap on the inlet section of the container.
Figure 6:
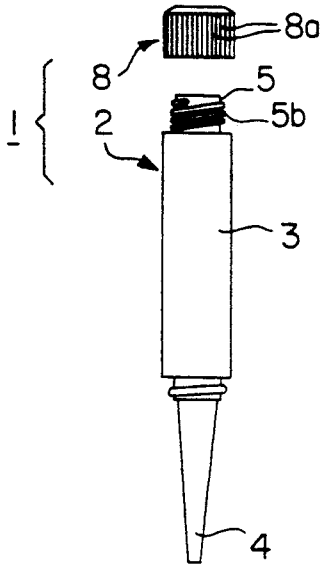
FIG. 6 PRIOR ART
FIG. 6 is an overall schematic view of a conventional adhesive agent container.

As seen in FIG. 5, the container 10 is positioned uprightly, the tip of a nozzle of adhesive supply (not shown) is inserted into the inlet section 14 through the opening 18 so that the container 10 is filled with appropriate amount of adhesive agent, approximately 2 grams, for example. After this, the bottom cap 21 is positioned directly above the main body 11 and is lowered so that the cap 21 covers the inlet section 14.

As shown in FIG. 5, when the bottom cap 21 is pushed in so as to cover the inlet section 14, the first projection 25 slides along the taper guide portion 15*a* of the annular step 15, and the opening 28 widens. When the first projection 25 has passed the annular step 15, the cap opening 28 returns to its original shape and diameter, and the first projection 25 catches on the engaging portion 15*b* of the annular step 15. In this state, the first projection 25 is in contact with base-end external circumferential surface 16 of the inlet section 14, but the second projection 26 is not in contact with tip-end external circumferential surface 17 of the inlet section 14.

Figure 1:
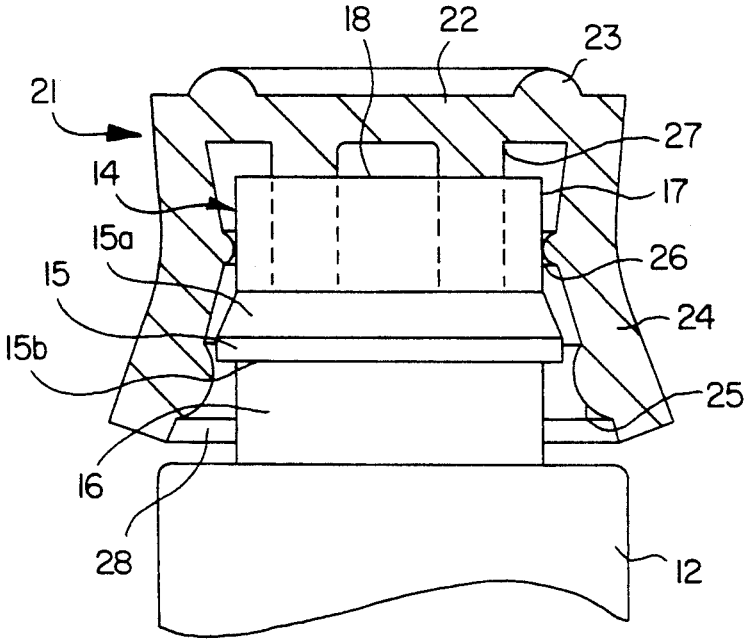
FIG. 1 is a partial cross sectional view of a part of adhesive container of the present invention, especially illustrating a situation wherein an internal pressure of the container is increased.

When the reservoir section 12 is pressed with the discharge opening 13 clogged, the internal pressure increases. As a result, the bottom cap 21 is deformed as shown in FIG. 1. The first projection 25 comes loose from the engaging portion 15*b*, and the bottom cap 21 is forced to pop out. However, since the side wall part 24 of the cap 21 bends because of the deformation caused by the pressure increase, the second projection 26 is strongly pressed against the tip-end external circumferential surface 17 of the inlet section 14. Thus, the bottom cap 21 does not come off the inlet section 14.

As seen from the above, a series of operations to fill the adhesives in the container and to attach the cap thereon can be performed more quickly and smoothly than in conventional containers. Accordingly, productivity is greatly improved.

In the container of the present invention, although the bottom cap is attached using relatively little force, no adhesive leakage would occur from the inlet section. In the containers that use conventional screw-on type bottom caps, leakage of 0.5 to 1% of the adhesives is inevitable. Accordingly, the container of the present invention makes it possible to achieve a great improvement in product yield compared to a conventional one.

The bottom cap of the container of the present invention can be quickly and easily attached to the inlet section during manufacture. Accordingly, the container can be mass-produced. In addition, since the air-tightness of the container is sufficiently maintained, there are no adhesive leakage would occur during manufacture. Thus, a more sufficient yield can be obtained.

Once the bottom cap is attached to the inlet section, the cap does not easily come off by itself because of the first and second projections. Accordingly, there is no danger of leakage accident that would be caused by user's inadvertent loosening of the bottom cap.

Moreover, since there is no need to knurl the external circumferential surface of the bottom cap, labels can be glued to the bottom cap.

I claim:

1. An adhesive container comprising:

a reservoir section which accommodates an adhesive agent;

a discharge opening section provided at one end of said reservoir section;

an inlet section provided at the other end of said reservoir section; and a bottom cap attached to said inlet section, said adhesive container further comprising:

an annular step formed on an outer surface of said inlet section;

a first projection formed on an inner surface of said bottom cap near the opening end thereof so as to engage with said annular step, and a second projection formed on the inner surface of said bottom cap near closed end thereof so as to face an outer surface of said inlet section, said second projection coming into contact with said outer surface of said inlet section when a side wall of said bottom cap is bent outwardly.

2. An adhesive agent container equipped with a liquid reservoir section which accommodates a quick-adhesive agent, a discharge pending section which is installed on a top portion of said liquid reservoir part and is used to discharge said adhesive agent liquid, an adhesive inlet section which is installed on a bottom portion of said adhesive reservoir section and is used to fill the inside of said adhesive reservoir section with the adhesive agent, and a bottom cap which covers said adhesive inlet section, wherein said adhesive agent container is characterized in that a first projection is formed on an internal circumferential surface of said bottom cap toward an opening end of said bottom cap and engages with an annular step part formed on the external circumferential surface of said adhesive inlet section, and a second projection is formed on the internal circumferential surface of the bottom cap toward a closed end of said bottom cap and faces an area of aid external circumferential surface of said inlet section located closer to an opening end of said inlet section than said annular step portion, said second projection contacting said external circumferential surface when a side wall of said cap is bent outwardly.

* * * * *